United States Patent [19]

Hirai

[11] 4,080,976

[45] Mar. 28, 1978

[54] THREE-STAGE COLLAPSIBLE UMBRELLA

[75] Inventor: Masaaki Hirai, Osaka, Japan

[73] Assignee: Asahi Kogyo Co., Ltd., Osaka, Japan

[21] Appl. No.: 797,516

[22] Filed: May 16, 1977

[51] Int. Cl.[2] ..... A45B 19/10

[52] U.S. Cl. ..... 135/25 R; 135/27

[58] Field of Search ..... D88/1; 135/22, 23, 25 R, 135/25 A, 26, 27, 29

[56] References Cited

U.S. PATENT DOCUMENTS

| | | | |
|---|---|---|---|
| 1,104,598 | 7/1914 | Wyskosky | 135/25 R |
| 1,124,353 | 1/1915 | Stein | 135/25 R |
| 1,473,906 | 11/1923 | Hartzell | 135/23 |
| 1,490,924 | 4/1924 | Hartzell | 135/23 |
| 1,567,861 | 12/1925 | Rothchild | 135/23 |
| 3,457,931 | 7/1969 | Shimizu | 135/26 |

FOREIGN PATENT DOCUMENTS

| | | | |
|---|---|---|---|
| 735,913 | 4/1943 | Germany | 135/25 R |

*Primary Examiner*—Werner H. Schroeder
*Assistant Examiner*—Conrad L. Berman

[57] ABSTRACT

A three-stage collapsible umbrella of the type which has rib assemblies each comprising a main rib, support rib, roof rib and auxiliary support rib, which are arranged and mutually related so that the ribs are stretched and closed automatically in response to umbrella opening and closing operations, additional tip ribs pivotally connected to the ends of roof ribs which form, when the umbrella is opened, extensions of roof ribs and is folded, when the umbrella is closed, alongside the roof ribs, and elongate sliding means which are operatively connected to the rib assemblies and tip ribs so that the tip ribs are stretched automatically by the pulling action of the sliding means when the rib assemblies are stretched. Each of the elongated sliding means is supported so that the sliding means is independently movable by a small distance along the lengthwise direction thereof. The umbrella is particularly provided with spring means each of which forces each of the elongated sliding means associated therewith to slide toward a direction of folding each of the tip ribs during the umbrella closing operation until such tip rib has been folded. The tip ribs are thus folded automatically in response to the umbrella closing operation. The spring means further act as spring means for automatically closing the umbrella.

4 Claims, 6 Drawing Figures

THREE-STAGE COLLAPSIBLE UMBRELLA

BACKGROUND OF THE INVENTION

This invention relates to a novel and improved collapsible umbrella, and more particularly to a novel collapsible umbrella of the type having rib assemblies each of which comprises a main rib which is pivotally supported at one end thereof by a rib holder fixedly mounted on the top end of a shaft, a support rib which is pivotally supported at one end thereof by a runner slidably mounted on the shaft and to which the other end of the main rib is pivotally connected at an intermediate portion of the support rib, a roof rib which is pivotally supported at an intermediate portion thereof by the support rib at the other end of such support rib, and an auxiliary support rib which is pivotally connected at one end to an intermediate portion of the main rib and at the other end to one end of the roof rib, the rib assemblies being fashioned such that such assemblies are stretched and folded automatically when the runner is moved upwardly and downwardly on and along the shaft.

Collapsible umbrellas of this type are disclosed in, for example, U.S. Pat. Nos. 3,467,115; 3,672,381 and 3,693,642 and may be employed for use with a great convenience because ribs or rib assemblies are stretched or opened automatically when the umbrella is handled so as to open the same, whereas such ribs or rib assemblies are folded or closed automatically when the umbrella is handled so as to close the same. When a collapsible umbrella of this type is structured as a three-stage collapsible umbrella for the purpose of shortening folded or collapsed length of the umbrella, tip ribs are additionally provided which are pivotally connected at base ends thereof to the free ends of the roof ribs. While each of such tip ribs provides an extension of a roof rib when the umbrella is opened, such tip rib is folded alongside the roof rib when the umbrella is closed. In such three-stage collapsible umbrella, there are usually provided alongside the roof ribs elongated sliding means for stretching automatically the tip ribs when the umbrella is opened. Each of such elongated sliding means known per se from, for example, U.S. Pat. No. 3,457,931 is operatively connected at base end to the mentioned rib assembly and at the opposite end to the tip rib through a bent connecting means in a fashion such that the tip rib is stretched automatically, when the rib assembly is opened or stretched, by the pulling action of the sliding means which action is caused by the opening or stretching of the rib assembly.

Contrarily to a two-stage collapsible umbrella of the type mentioned, such three-stage collapsible umbrella according to the prior art causes an inconvenience that only the tip ribs provided for shortening the folded length of the umbrella are not folded or closed automatically when the umbrella is handled to close the same because the elongated sliding means provide no pushing action to the bent connecting means for folding the tip ribs. It is thus required in use that the tip ribs are manually folded one by one after the umbrella has been closed.

Accordingly, a primary object of the present invention is to provide a novel three-stage collapsible umbrella of the mentioned type in which tip ribs are also folded or closed automatically when the umbrella is handled to close the same.

SUMMARY OF THE INVENTION

In the three-stage collapsible umbrella according to the present invention, spring means are particularly provided at between the roof ribs and elongated sliding means each of which spring means forces each of the sliding means associated therewith to slide toward the direction of folding the tip rib associated to such sliding means during the closing operation of umbrella until such tip rib has been folded. By a cooperation of such spring means with the elongated sliding means, the tip ribs are folded automatically when the umbrella is handled to close the same.

It is to be noted that such spring means which are separately provided force all of the ribs and the runner to move toward the direction of closing the umbrella even at the opened state of the umbrella so that the umbrella may be closed automatically only by unlocking the runner from the shaft so as to permit a downward movement of such runner.

For avoiding damages of umbrella members which damages may be caused by an unexpected manual stretching of the folded tip ribs, each of the elongated sliding means is provided with a freedom of sliding by a small distance along the lengthwise direction thereof. When the tip ribs are manually stretched, such tip ribs are displaced independently toward the base ends thereof against the force of spring means so that no force causing damages of the elongated sliding means and/or ribs is applied.

BRIEF DESCRIPTION OF THE DRAWINGS

Another objects of the present invention and its attendant advantages will become readily apparent as the specification is considered in conjunction with the accompanying drawings, in which.

DESCRIPTION OF PREFERRED EMBODIMENTS

Figure 1:
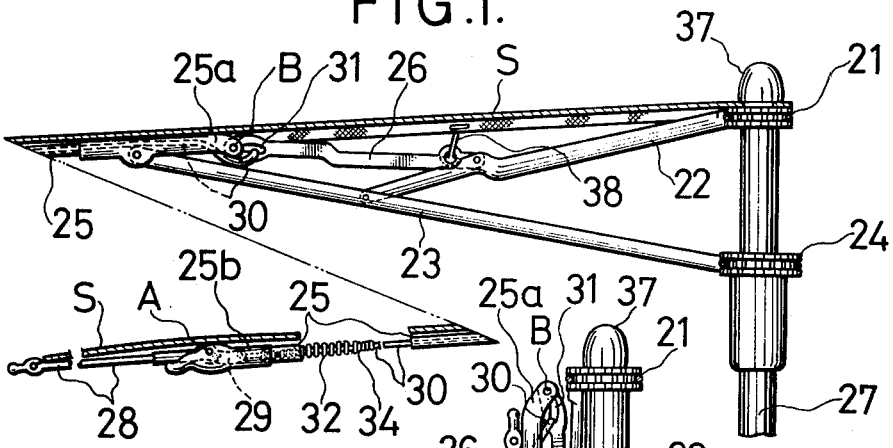
FIG. 1 is a front elevational view, partially cut away and partially in section, of a part of an embodiment of the three-stage collapsible umbrella according to the present invention showing the opened state of umbrella, in which respective ribs are illustrated by only one of such ribs for simplicity and for clarity.
Figure 2:
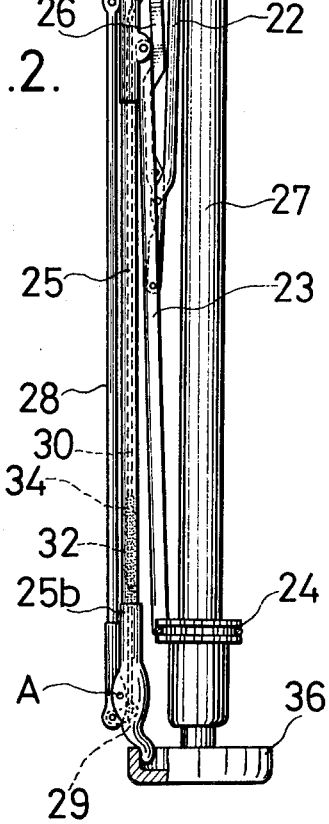
FIG. 2 is a front elevational view, partially in section and partially omitted, of the three-stage collapsible umbrella shown in FIG. 1 showing the folded state of umbrella, in which respective ribs are similarly illustrated by only one of such ribs.

Referring now to the drawings, there is shown a preferred embodiment of the three-stage collapsible umbrella according to the prevent invention is FIGS. 1 to 4. As is usual in a collapsible umbrella of the type mentioned at the beginning, the collapsible umbrella shown has rib assemblies each of which comprises a main rib 22 which is pivotally supported at one or top end thereof by a fixed upper tackle or hollow cylindrical rib holder 21 which in turn is fixedly mounted on the top end of an umbrella shaft 27, and a support rib 23 which is pivotally supported at one or base end thereof by a movable lower tackle or hollow cylindrical runner 24 which in turn is slidably mounted on the shaft 27 so that the runner may be raised and lowered on and along the shaft. The other or lower end of the main rib 22 is pivotally connected to an intermediate portion of the support rib 23, as shown in FIGS. 1 and 2. As is also usual, each of the rib assemblies further comprises a roof rib 25 which is pivotally supported at an intermediate portion near its top end by the support rib 23 at the other or top end of such support rib, and an auxiliary support rib 26 which is pivotally connected at one end to an intermediate portion of the main rib 22 and at the other end to one or top end of the roof rib 25. The rib assemblies comprising the mentioned ribs 22, 23, 25 and 26 are fashioned such that the assemblies or all of the ribs 22, 23, 25 and 26 thereof are stretched or opened automatically when the runner 24 is raised manually on and along the shaft 27 which is formed into a telescopically extensible shaft in a known fashion and which is extended from the shortend or contracted state shown in FIG. 2 before raising the runner 24, whereas the rib assemblies or all of the ribs 22, 23, 25 and 26 thereof are folded or closed automatically when the runner 24 is lowered manually on and along the shaft 27 from the uppermost position shown in FIG. 1, as is usual in a collapsible umbrella of the type mentioned at the beginning. The collapsible umbrella shown further has tip ribs 28 each of which is pivotally connected at one or base end and at position A to a bearing piece **25*b* which in turn is fixedly secured to the other or lower end of each roof rib 25. To each of the tip ribs 28 is operatively connected through a bent connecting means 29 an elongated sliding means 30 for stretching the tip rib known per se which sliding means may be a metal wire or a metal rod having a smaller diameter. As is usual, each of the elongated sliding means 30 which lie along the roof ribs 25 is operatively connected at the base end thereof to each of the mentioned rib assemblies so that the sliding means is pulled to slide toward the base end by the rib assembly when such assembly is stretched or opened, whereby the bent connecting means 29 is displaced or revolved toward a direction of stretching the tip rib 28. Each of the tip ribs 28 is thus stretched automatically together with the rib assembly associated therewith resulting in the stretched or opened state shown in FIG. 1. In the umbrella shown, another bearing piece 25*a* is fixedly secured to the base end of each roof rib 25 for pivotally connecting the support rib 23 and auxiliary support rib 26 to the roof rib 25 through such bearing piece 25*a*. A fabric cover S shown in FIG. 1 the top end of which is secured at between the rib holder 21 and a cap 37 fixedly secured to the top of the shaft 27 is laid on and along the roof ribs 25 and tip ribs 28, each of which forms an extension of the roof rib 25 associated therewith at the stretched or opened state shown in FIG. 1, and is secured at the lower end thereof to the free ends of the tip rib 28** by stitching.

For achieving the mentioned operation of the elongated sliding means 30, such sliding means may be connected to either the support ribs 23 or the auxiliary support ribs 26 at portions of such ribs near the pivot points to the roof ribs 25 because such portions are displaced upwardly relative to the roof ribs 25 when the rib assemblies are stretched or opened from the folded state shown in FIG. 2 to the opened state shown in FIG. 1 so that the sliding means 30 are pulled toward the base ends thereof resulting in automatic stretching of the tip ribs 28. In the umbrella shown in FIGS. 1 to 4, the base end of each elongated sliding means 30 which extends through a groove of the roof rib 25 having U-letter shaped cross-section is connected or supported by the auxiliary support rib 26 in a fashion detailed hereinafter. Each of the auxiliary support ribs 26 which have been formed from a flat metal material by employing a die is provided at the pivot point B to the roof rib 25 with a slot 31 which has been formed together with the die processing. This slot 31 extends along the lengthwise direction of the auxiliary support rib 26 by a small distance. The base end of each sliding means 30 is formed into a hook **30*a* by which such sliding means is slidably hooked to the slot 31. The sliding means 30 is thus supported at the base end thereof by the auxiliary support rib 26 so that such sliding means is freely or independently movable along the lengthwise direction thereof by a small distance in correspondence to the length of the slot 31**.

Each elongated sliding means 30 which is hooked or pivotally connected at opposite end thereof to the bent connecting means 29 by another hook **31*b* formed at such opposite end is forced to slide by a tension coil spring 32 detailed hereinafter. This tension coil spring 32 which is arranged within the groove of each roof rib 25 at a location near the lower end of such roof rib is fixedly secured at the lower end portion thereof to the roof rib 25 by means of pressed securing portion 33 formed to such roof rib. The tension coil spring 32 through which the elongated sliding means 30 extends is operatively connected at another or upper end portion thereof to the sliding means 30 by means of a narrowed end portion 32*a* formed to the spring and a stop 34 having an enlarged diameter formed to the sliding means 30 by pressing which stop is engaged to the narrowed end portion 32*a* at within the coil spring 32, as clearly seen from FIGS. 3 and 4. The elongated sliding means 30 is thus always forced to slide toward a direction of arrow F shown in FIG. 4 by the tension spring 32. As can be understood with ease, the direction F of forcing the sliding means 30 is such that the bent connecting means 29 is displaced or revolved by such forcing toward the direction of folding the tip rib 28 associated therewith. The tension spring 32 is particularly fashioned such that it forces the elongated sliding means 30 to slide toward the direction of folding the tip rib 28 during the umbrella closing operation, which is carried out by lowering the runner 24 from the uppermost position thereof shown in FIG. 1 to the lowermost position thereof shown in FIG. 2, until the tip rib 28 has been folded alongside the roof rib 25, as shown in FIGS. 2 and 4. In other words, while the base end of the elongated sliding means 30 is displaced by an upward displacement of the auxiliary support rib 26 and, therefore, slot 31 caused by the umbrella closing operation to slide at within the slot 31 from the position shown in FIGS. 1 and 3, in which such base end is in abutment or engagement with a fronter end wall 31*a* of the slot, to the position shown in FIGS. 2 and 4 in which such base end is in abutment or engagement with a rearer end wall 31*b* of the slot, the tension spring 32 is fashioned or predetemined such that it takes either non-tensioned length, namely length which the spring 32 takes its at a condition in which no force is applied to such spring, or another length somewhat larger than such non-tensioned length at the state in which the base end of the sliding means 30 is in engagement of the end wall 31***b* of the slot 31 so that there remains no freedom of sliding of the means 30 toward the lower end of such means and in which the tip rib 28 is folded alongside the roof rib 25 as shown in FIGS. 2 and 4. The tension spring 32 thus forces the elongated sliding means 30 to slide toward the direction of arrow F either just before the state shown in FIGS. 2 and 4 or still at such state shown in FIGS. 2 and 4.

As shown in FIG. 2, the telescopically extensible shaft 27 has at the lower end thereof a handle 36. At between the auxiliary support ribs 26 and a part of the fabric cover S located between the main ribs 22 and auxiliary support ribs 26 are arranged cover pulling means 38 which are fixed at one ends to the inner face of the cover S and at another ends to the auxiliary ribs 26 at portions near the base ends of such ribs, as shown in FIGS. 1 and 2. Such cover pulling means 38 pulls the just mentioned part of the fabric cover S, when the rib assemblies are folded, into the clearance between the folded ribs 22 and 26 which are folded in a manner shown in FIG. 2.

The three-stage collapsible umbrella shown in FIGS. 1 to 4 operates as follows: When the shaft 27 is extended and then the umbrella is handled to open the same by raising the runner 24 from the state shown in FIG. 2, the ribs 22, 23, 25 and 26 are stretched or opened automatically, as is usual in a collapsible umbrella of this type. At the same time, each of the elongated sliding means 30 is pulled relative to the roof rib 25 toward the base end thereof, namely toward the opposite direction of arrow F, in response to the stretching revolution of the auxiliary support rib 26 so that the bent connecting means 29 is displaced toward a direction of stretching the tip rib 28, whereby each of the tip ribs 28 is stretched automatically, as is usual in a collapsible umbrella in which elongated sliding means for stretching tip ribs are equipped. In the umbrella shown in FIGS. 1 to 4, all of the ribs 22, 23, 25, 26 and 28 are thus stretched automatically to cause the state shown in FIGS. 1 and 3 in response to the raising of runner 24 on and along the shaft 27, namely in response to the handling for opening the umbrella. In closing the umbrella shown in FIGS. 1 to 4 from the opened state shown in FIGS. 1 and 3, not only the ribs 22, 23, 25 and 26 but the tip ribs 28 are folded automatically in a manner detailed hereinafter owing to the provision of the tension springs 32 which are particularly provided in this three-stage collapsible umbrella according to the present invention. When the runner 24 which is locked at the uppermost position shown in FIG. 1 by a conventional releaseable locking means (not shown) is lowered on and along the shaft 27, after releasing the locking of the locking means, so as to close the umbrella, the ribs 22, 23, 25 and 26 are folded automatically, as also the case of such ribs employed in a collapsible umbrella of this type according to the prior art. At the same time, because each of the tension springs 32 is fashioned such that it forces the elongated sliding means 30 associated therewith to slide toward the direction of arrow F during the closing operation even after the base end of such sliding means 30 has been in engagement with the rear end wall 31*b* of the slot 31 and until the folded state of tip rib 28 shown in FIGS. 2 and 4 has been attained, the bent connecting means 29 is displaced or revolved by such forcing of sliding means 30 by means of the tension spring 32 toward the direction of folding the tip rib 28 so that such tip rib 28 is also folded automatically to the folded state shown in FIGS. 2 ad 4. Thereafter, the state shown in FIG. 2 may be attained by shortening the shaft 27.

As detailed hereinbefore, there are achieved in the threestage collapsible umbrella shown in FIGS. 1 to 4 not only an automatical stretching or opening revolution of the tip ribs 28 in response to the umbrella opening operation but an automatical folding or closing revolution of such tip ribs 28 in response to the umbrella closing operation by the cooperation of the elongated sliding means 30 and tension springs 32. The umbrella shown in FIGS. 1 to 4 may thus be employed for use with a great convenience. This umbrella further has the following advantages which enhance convenience in use.

Figure 3:
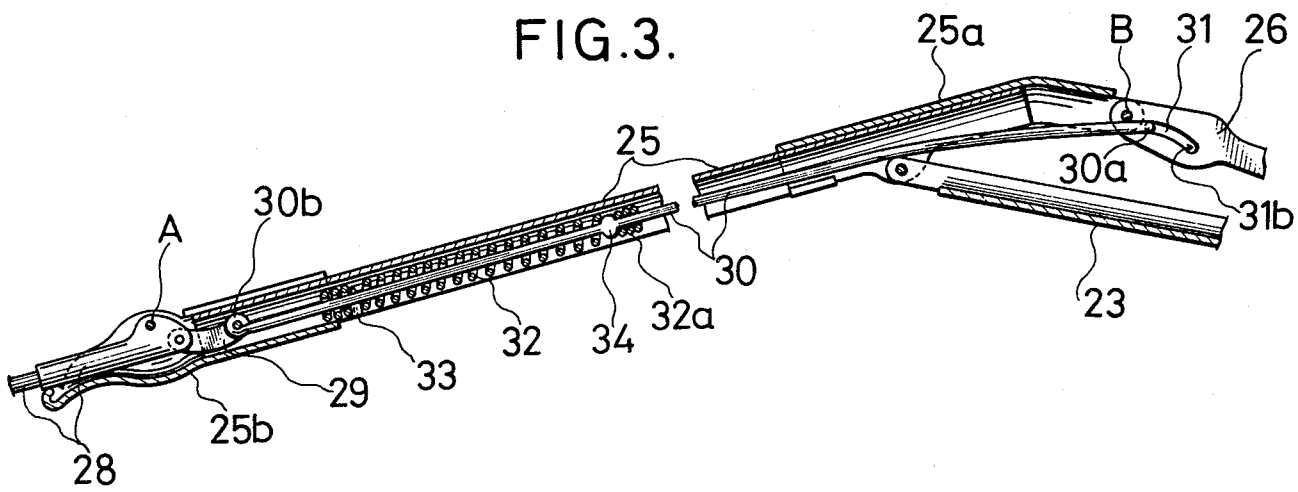
FIG. 3 is an enlarged sectional view, partially cut away, of a part of the three-stage collapsible umbrella shown in FIGS. 1 and 2 showing the opened state of umbrella.
Figure 4:
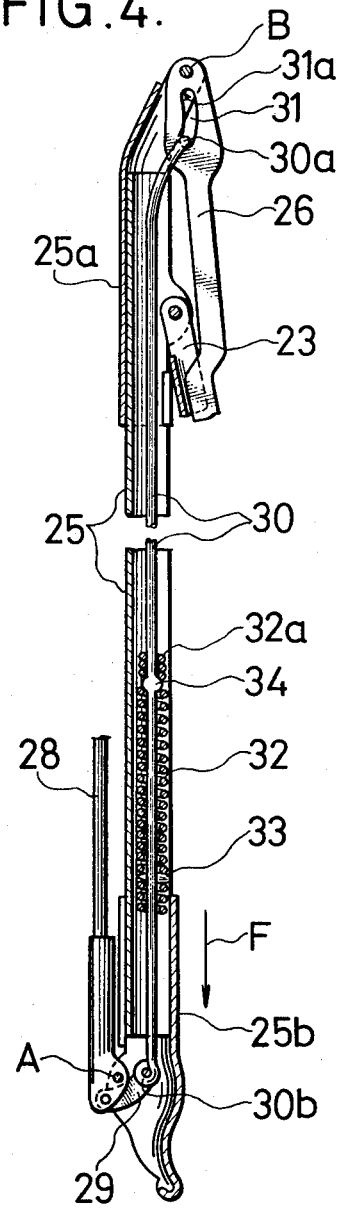
FIG. 4 is an enlarged sectional view, partially cut away, of the part shown in FIG. 3 showing the closed state of umbrella.

First, each tension spring 32 pulls or forces the elongated sliding means 30 to slide toward the direction of arrow F even at the umbrella opened state shown in FIGs. 1 and 3 so that the auxiliary support rib 26 and roof rib 25 associated therewith are forced to revolve toward a direction of folding even at such umbrella opened state. This means that, even at such umbrella opened state, the main rib 22 and support rib 23 which necessarily revolve together with the support rib 26 and roof rib 25 are also forced to revolve toward a direction of folding and also the runner 24 which necessarily moves or slides on and along the shaft 27 together with the revolution of the ribs 22, 23, 25 and 26 is forced to move downwardly. Consequently, when locking of the runner 24 is released at the opened state shown in FIG. 1, the runner 24 is moved downwardly automatically and all of the ribs are folded or closed automatically. The three-stage collapsible umbrella shown in FIGS. 1 to 4 may thus be closed or folded from the state shown in FIG. 1 only by unlocking the runner 24, that is a great convenience in use of the umbrella.

Next, because each of the tension springs 32 always forces the tip rib 28 associated therewith to revolve toward the direction of folding through the bent connecting means 29, the tip ribs 28 are laid, at the closed state of umbrella shown in FIGS. 2 and 4, alongside the roof ribs 25 at the most approached location toward such roof ribs 25. The three-stage collapsible umbrella shown in FIG. 1 to 4 is thus thin in the folded or closed state, that is a convenience in carrying this umbrella with such closed state. There is, of course, prevented by the force of the tension springs 32 an automatical swing or revolution of tip ribs 28 toward the direction of stretching during a carry of the closed umbrella.

Further, even when the folded tip ribs 28 are manually stretched unexpectedly by user, as is often experienced in umbrellas in which elongated sliding means for automatically stretching such tip ribs are provided, damage of the sliding means 30 and/or ribs that may be caused by such manual stretching of the tip ribs is prevented. This is because the elongated sliding means 30 may be displaced independently against the force of the tension springs 32 to slide toward the base end of such sliding means owing to the presence of the slots 31 to which the base ends of the sliding means 30 are hooked. Such displacement of each sliding means 30 toward the base end thereof is permitted by a sliding displacement of the base end of such sliding means at within the slot 31 from the end wall 31*b* toward the end wall 31*a*. The elongated sliding means 30 and ribs are subjected to no force damaging the same even at such unexpected manual stretching of the tip ribs 28.

As detailed hereinbefore, there are provided, in the three-stage collapsible umbrella according to the present invention, at between the roof ribs 25 and elongated sliding means 30 spring means which force the elongated sliding means 30, which are freely or independently movable by a small distance, to slide toward the direction of folding the tip ribs 28 during the closing operation of the umbrella until the tip ribs have been folded. Such spring means may be either tension spring means such as the tension springs 32 employed in the embodiment shown in FIGS. 1 to 4 or compression spring means.

Figure 5:
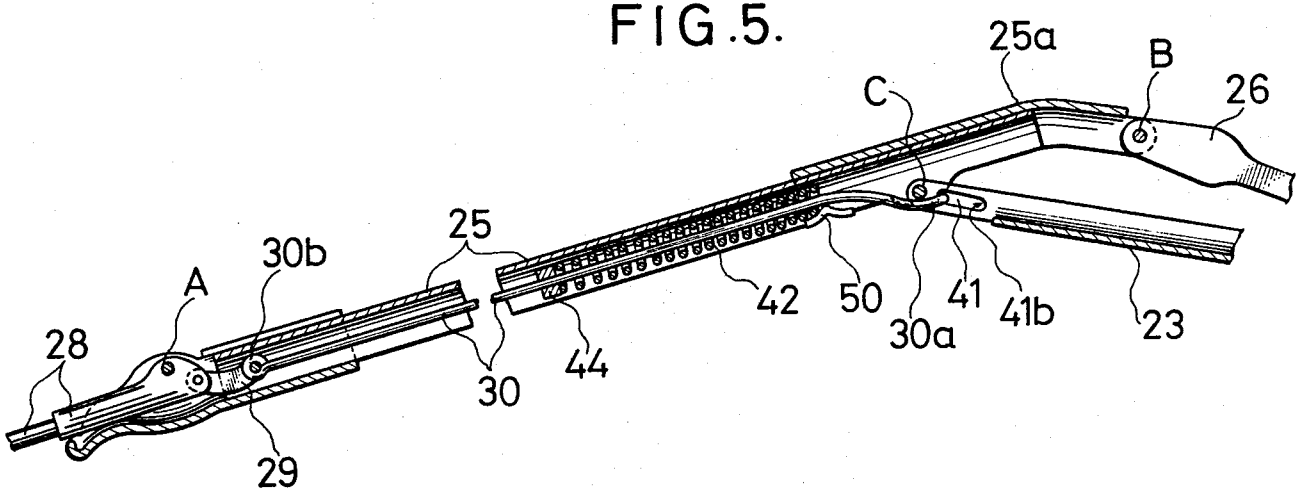
FIG. 5 is a sectional view, partially cut away, similar to FIG. 3 but showing a part of another embodiment of the three-stage collapsible umbrella according to the present invention and showing the opened state of umbrella.
Figure 6:
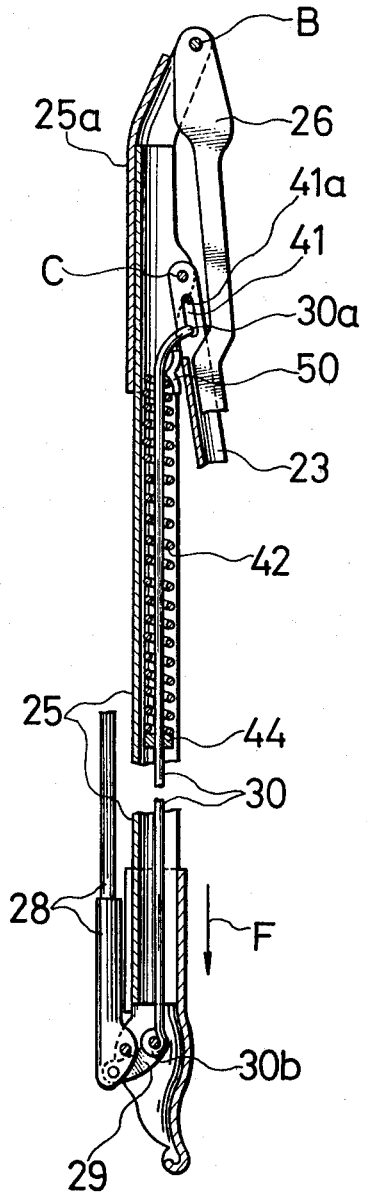
FIG. 6 is a sectional view, partially cut away, similar to FIG. 4 but showing the part of the umbrella shown in FIG. 5 and showing the closed state of umbrella.

In FIGS. 5 and 6, there is shown another embodiment of the three-stage collapsible umbrella according to the present invention, in which compression springs 42 are employed as spring means for forcing the elongated sliding means 30 to slide toward the direction of folding the tip ribs 28. In this another embodiment, the base end of each elongated sliding means 30 is operatively connected to each support rib 23 by hooking slidably such base end by means of the base end hook 30*a* to a slot 41 which is formed to the support rib 23 at a location near pivot point C of such support rib to each roof rib 25. The elongated sliding means 30 is thus supported so that such sliding means is freely or independently movable by a small distance along the lengthwise direction thereof in correspondence to the length of the slot 41. As shown in FIGS. 5 and 6, each of the compression springs 42 which are formed as coil springs and are mounted on the sliding means 30 is engaged at the lower end thereof to a tubular stop 44 fixedly secured to the sliding means so that displacement of such compression spring 42 along the lengthwise direction thereof relative to the sliding means 30 is prevented. Eachh compression coil spring 42 which is arranged within the U-letter shaped groove of each roof rib 25 is engaged at the upper or base end thereof to a pressed stop 50 formed to the lower end of the bearing piece 25*a* so that displacement of the spring 42 toward the base end of the sliding means 30 is prevented, as also shown in FIGS. 5 and 6. Consequently, the compression spring 42 also forces the elongated sliding means 30 to slide toward the direction of arrow F(FIG. 6), namely toward the direction of folding the tip rib 28. As is the case of each tension spring 32 employed in the first embodiment, this compression spring 42 is fashioned such that it forces the elongated sliding means 30 to slide toward the direction F of folding the tip rib 28, during the umbrella closing operation, even after the base end of such sliding means 30 has been displaced at within the slot 41 from a position of engaging to the fronter end wall 41*a* to another position of engaging to the rearer end wall 41*b* and until the tip rib 28 has been folded.

Consequently, in the three-stage collapsible umbrella shown in FIGS. 5 and 6, the tip ribs 28 are folded automatically when the umbrella is closed from the opened state shown in FIG. 5 to the closed state shown in FIG. 6, similarly to those of the first embodiment shown in FIGS. 1 to 4. Similarly, the compression springs 42 act also as spring means for automatically closing the umbrella, as is the case of the tension springs 32, and such compression springs 42 keep the folded tip ribs 28 at the most approached location toward the roof ribs 25 in the closed state of umbrella shown in FIG. 6. Further, the slots 41 formed to the support ribs 23 permit an independent sliding displacement of the elongated sliding means 30 toward the base ends of such sliding means when the tip ribs 28 are manually stretched, whereby damage of the sliding means and/or ribs is prevented.

The collapsible umbrella shown in FIGS. 5 and 6 may be modified such that the elongated sliding means 30 are operatively connected to the auxiliary support ribs 26, as is the case of the umbrella shown in FIGS. 1 to 4. Such connection of elongated sliding means 30 to the auxiliary support ribs 26 is advantageous, because stitching of an intermediate portion of the fabric cover S to the roof ribs 25 at locations near the pivot points C is not troubled by the base end portions of the sliding means 30 which portions are located within the grooves of the roof ribs 25 at such stitching locations owing to the connection of sliding means to the auxiliary support ribs 26. The tubular stops 44 may, of course, be substituted by pressed stops formed to the sliding means 30 similarly to the stops 34. Spring means which may be either tension spring means such as the tension springs 32 or compression spring means such as the compression springs 42 may be provided at between the roof ribs 25 and elongated sliding means 30 at optional location along the sliding means 30.

Although each of the elongated sliding means 30 is provided at the base end thereof with some freedom of sliding displacement by the slot 31 or 41 perforated through the rib 26 or 23 in the embodiments shown, such freedom may be provided by another means which connects the base end of sliding means to such rib loosely with permitting some independent displacement of the sliding means. Further, the present invention may be embodified as a three-stage collapsible umbrella of the type having automatically opening mechanism for umbrella which is known per se from, for example, U.S. Pat. No. 3,672,381.

What is claimed is:

1. A three-stage collapsible umbrella having rib assemblies each of which comprises a main rib which is pivotally supported at one end thereof by a rib holder fixedly mounted on the top end of a shaft, a support rib which is pivotally supported at one end thereof by a runner slidably mounted on the shaft and to which the other end of the main rib is pivotally connected at an intermediate portion of the support rib, a roof rib which is pivotally supported at an intermediate portion thereof by the support rib at the other end of such support rib, and an auxiliary support rib which is pivotally connected at one end to an intermediate portion of the main rib and at the other end to one end of the roof rib, the rib assemblies being fashioned such that such assemblies are stretched and folded automatically when the runner is moved upwardly and downwardly on and along the shaft, the umbrella further having tip ribs each of which is pivotally connected at one end thereof to the other end of each of the roof ribs, and elongated sliding means arranged at alongside the roof ribs each of which means is operatively connected at base end to each of said rib assemblies and at the opposite end to each of said tip ribs through bent connecting means in a fashion such that the tip rib is stretched automatically by the pulling action of the sliding means when the rib assembly is stretched, characterized in that each of said elongated sliding means is supported so that the means is independently movable by a small distance along the lengthwise direction thereof, and that spring means are provided at between said roof ribs and elongated sliding means each of which spring means forces each of said elongated sliding means to slide toward the direction of folding the tip rib associated therewith during the closing operation of umbrella until the tip rib has been folded.

2. The three-stage collapsible umbrella as claimed in claim 1, characterized in that each of said spring means comprises a tension spring which is fixed at one end to each of said roof ribs and is engaged at the other end to a stop on each of said elongated sliding means from the direction of base end of the sliding means, said tension springs always forcing the sliding means toward the direction of folding said tip ribs.

3. The three-stage collapsible umbrella as claimed in claim 1, characterized in that each of said spring means comprises a compression spring which is engaged at one end to a stop on each of said elongated sliding means from the direction of base end of the sliding means and at the other end to another stop on each of said roof ribs from the opposite direction, said compression springs always forcing the sliding means toward the direction of folding said tip ribs.

4. The three-stage collapsible umbrella as claimed in claim 1, characterized in that each of said elongated sliding means is connected at the base end thereof to each of said auxiliary support ribs through connecting means which permits an independent displacement of the sliding means by said small distance along the lengthwise direction thereof.

* * * * *